US007387366B2

(12) United States Patent
Ingham et al.

(10) Patent No.: US 7,387,366 B2
(45) Date of Patent: Jun. 17, 2008

(54) PRINTHEAD

(75) Inventors: Ian Philip Butler Ingham, Essex (GB); Sebastien Eric Bregeaud, Cambridgeshire (GB); Daniel Richard Mace, Cambridgeshire (GB); Keith Turner, Hertfordshire (GB)

(73) Assignee: Tonejet Limited, Herts (GB)

( * ) Notice: Subject to any disclaimer, the term of this patent is extended or adjusted under 35 U.S.C. 154(b) by 112 days.

(21) Appl. No.: 10/514,167

(22) PCT Filed: May 30, 2003

(86) PCT No.: PCT/GB03/02263

§ 371 (c)(1),
(2), (4) Date: Nov. 12, 2004

(87) PCT Pub. No.: WO03/101741

PCT Pub. Date: Dec. 11, 2003

(65) Prior Publication Data

US 2005/0174387 A1 Aug. 11, 2005

(30) Foreign Application Priority Data

May 31, 2002 (EP) ..... 02253856

(51) Int. Cl.
*B41J 2/06* (2006.01)
*B41J 2/015* (2006.01)

(52) U.S. Cl. ..... 347/55; 347/20

(58) Field of Classification Search ..... 347/20, 347/40, 54, 55
See application file for complete search history.

(56) References Cited

U.S. PATENT DOCUMENTS

| | | | | |
|---|---|---|---|---|
| 3,805,273 | A * | 4/1974 | Brady et al. | 347/74 |
| 5,625,396 | A * | 4/1997 | Keefe et al. | 347/84 |
| 6,334,671 | B1 * | 1/2002 | Umehara | 347/68 |
| 6,371,601 | B1 | 4/2002 | Katakura | |

FOREIGN PATENT DOCUMENTS

| | | |
|---|---|---|
| EP | 0 811 491 | 12/1997 |
| EP | 0 838 335 | 4/1998 |
| JP | 03 178446 | 8/1991 |
| JP | 05 131645 | 5/1993 |
| JP | 06 143601 | 5/1994 |
| JP | 06 198884 | 7/1994 |
| JP | 07 164640 | 6/1995 |
| JP | 10 086374 | 4/1998 |
| JP | 10 286959 | 10/1998 |
| JP | 2000 025218 | 1/2000 |
| WO | 00 38928 | 7/2000 |
| WO | 01/12442 | 2/2001 |

* cited by examiner

*Primary Examiner*—An H Do

(57) ABSTRACT

A printhead comprising: a housing having an inlet for the supply of ink; an array of ejection locations for the ejection of ink droplets; an ink supply pathway for the passage of ink from the inlets to the ejection locations, wherein the ink supply pathway comprises at least one divergent ink manifold; and an outlet manifold for receiving ink from the ejection locations.

10 Claims, 6 Drawing Sheets

PRINTHEAD

The present invention relates to a printhead. More particularly, the method and apparatus employed may be generally of the type described in WO-A-93/11866, the disclosure of which is incorporated herein by reference. In the above patent specification, an agglomeration or concentration of particles is achieved in the printhead and, at the ejection location, the agglomeration of particles is then ejected on to a substrate, e.g. for printing purposes. In the case of an array printer, plural cells may be arranged in one or more rows.

It is well known to generate and eject particles by use of electrostatic fields from a plurality of ejection locations wherein each of the ejection locations is supplied with ink. It is important that the ink reaches each ejection location in the array under the same conditions i.e. no location is without ink when others have been supplied, and in the same condition, such as temperature, pressure and concentration. This ensures that the composition of the ink used during printing is identical at each ejection location and that locations which may otherwise be at one of the extremes of an array, and therefore susceptible to not receiving an adequate supply of ink, are supplied with the same amount of ink under the same conditions as the ejection locations at the centre of the array.

Furthermore, when an intermediate electrode is provided surrounding the array of ejection locations, it is imperative that the intermediate electrode can be quickly and accurately positioned in such a manner that does not increase the risk of damage occurring to the ejection location which it surrounds. Clearly, damage of any of the ejection locations is undesirable as it will affect the quality and accuracy of any printing which is carried out by the printhead.

Therefore, it is the aim of the present invention to provide a printhead which overcomes the problems identified above.

According to the present invention, there is provided a printhead comprising:

a housing having an inlet for the supply of ink;

an array of ejection locations for the ejection of ink droplets;

an ink supply pathway for the passage of ink from the inlet to the ejection locations, wherein the ink supply pathway comprises at least one divergent ink manifold, and an outlet manifold for receiving ink from the ejection locations.

Preferably, the manifold is divergent in the direction from the inlet to the outlet.

Preferably, the manifold includes at least one inlet and one outlet for the passage of ink, the outlet supplying ink to the array of ejection locations.

The manifold is preferably symmetrical about a line normal to and in the centre of the array of ejection locations.

The manifold may take the form of a triangular passageway and the inlet may be provided at an apex of the manifold and the outlet(s) is (are) on the side of the manifold opposite the inlet.

Alternatively, the manifold may take the form of a substantially semi circular chamber, with the outlet(s) from the chamber being located on the substantially straight boundary of the manifold. The manifold may also take the form of a particularly elliptical or parabolic chamber. Preferably, the inlet is therefore located at the focus of the shape of the manifold.

In the arrangement whereby the array of ejection locations is very wide, it is envisaged that a plurality of ink supply manifolds could be provided such that each supplies a substantially equal portion of the array. The inlets to each of the manifolds may be supplied by a common manifold of the type previously described, such that the ink which is supplied to the ejection locations is still under the same conditions across the entire array, as it has initially been supplied through a single inlet to the first pathway.

The printhead may further be provided with a fluid flow layer in which a plurality of fluid passageways are provided and through which a gas or a liquid, such as a rinse agent, can be caused to flow. Such flow can be utilised to clean the channels or to clean the intermediate electrode.

The outlet manifold may have the same form as the inlet manifold or may be a different shape. Preferably the outlet manifold is convergent from its inlet towards its outlet. The shape of the outlet manifold is important in ensuring that the negative pressure applied to the printhead is uniform and that all of the ink is recirculated, such that no pockets of static ink are created.

The cross sectional area of the manifold(s) may be kept constant, such that as the width increases, the thickness is reduced.

The manifolds may be provided with a plurality of ink inlets or may alternatively be provided with a single inlet. The outlet manifold is preferably provided with a single outlet for returning the ink to a bulk ink supply.

It is preferable that the upper edges when in use, of the manifolds, are curved so that any air bubbles that are present are caused to float to the top of the manifold. The manifold is preferably provided with one or more air bleed outlets for the removal of air bubbles. It is preferable that an air bleed is located at the apex of a manifold.

One or both of the manifolds may be provided with one or more support structures to maintain the required thickness of the manifold.

A second aspect of the present invention provides a printhead comprising:

a housing;

an array of ejection locations for dispensing ink droplets; and an intermediate electrode surrounding the array of ejection locations;

wherein the intermediate electrode is removably connected to the housing.

Preferably the intermediate electrode is connected by means of a kinematic mount.

The printhead may also include one or more magnets mounted on one of the housing or the intermediate electrode for attracting the other of the housing and the intermediate electrode.

The kinematic mount comprises recesses on either the printhead or the intermediate electrode, one of which is conical, one of which is V-shaped, and one of which has a flat bottom. The other of the printhead and intermediate electrode is preferably provided with ball bearings which, when the intermediate electrode is mounted to the housing, are located within the corresponding recesses.

Additional magnets may be provided on one or both of the housing and the intermediate electrode.

The contact inserts of the kinematic mount may be electrically conductive to provide an electrical contact to the intermediate electrode. The inserts may be gold plated.

A third aspect of the present invention provides a printhead comprising:

a housing;

an array of ejection locations for dispensing ink droplets;

an intermediate electrode surrounding the array of ejection electrodes; and a fluid flow layer having at least one passageway through which, in use, a fluid can be caused to flow, the fluid being directed towards one or both of the array of ejection locations or to the intermediate electrode.

The fluid may be a gas, such as air or may additionally or alternatively be a liquid, such as a rinse agent or a solvent In both cases, the fluid flow causes ink deposits to be removed from either the ejection locations or from the intermediate electrode.

A fourth aspect of the present invention includes a method of cleaning a printhead, the printhead having a housing, an array of ejection locations for dispensing droplets and an intermediate electrode surrounding the array of ejection locations, the method comprising the steps of:

supplying pressurised cleaning fluid to a fluidic network within the housing;

directing the pressurised cleaning fluid towards one or both of the array of ejection locations and the intermediate electrode.

Preferably, the cleaning fluid includes one of compressed gas and a liquid which are preferably air and a rinse agent respectively. Preferably, the cleaning fluid is collected after cleaning, is filtered and can therefore be reused.

One example of the present invention will now be described with reference to the accompanying drawings, in which.

Figure 5A:
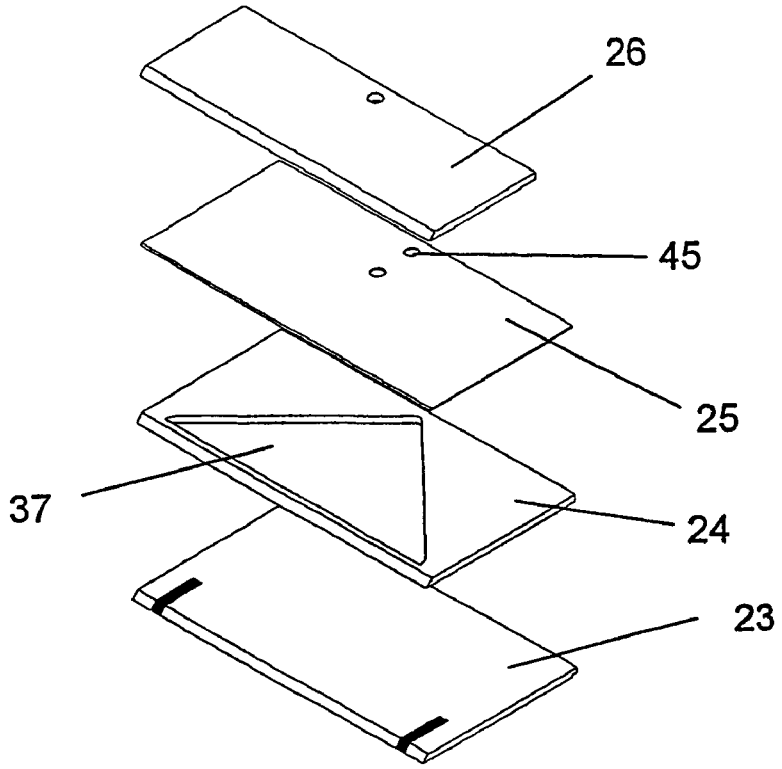
Figure 5B:
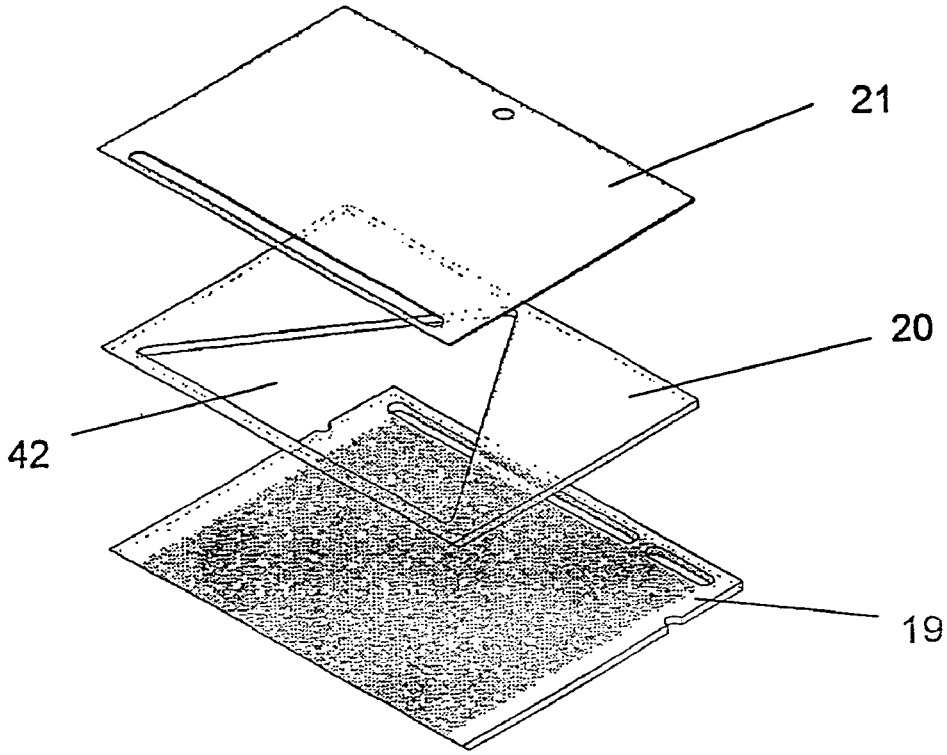
Figure 6A:
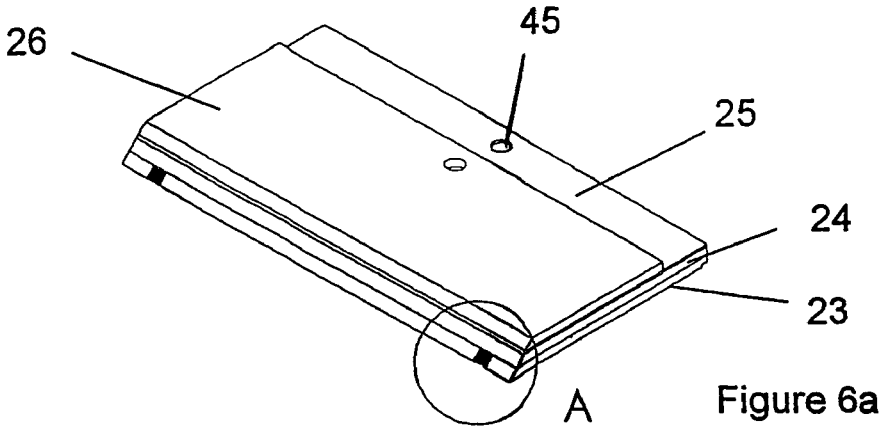
Figure 6B:
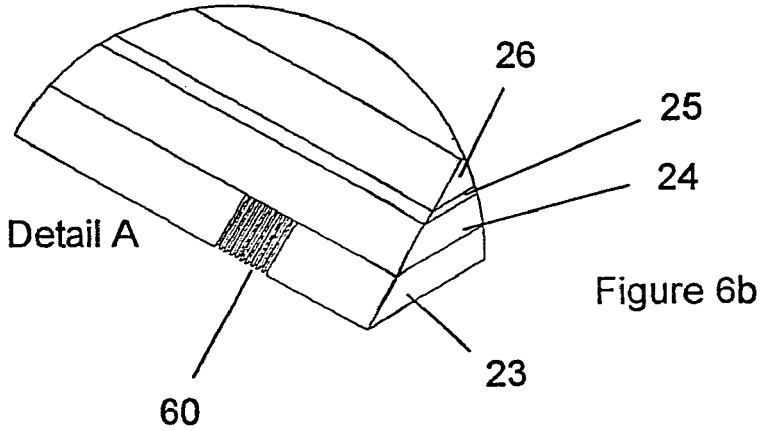
Figure 6C:
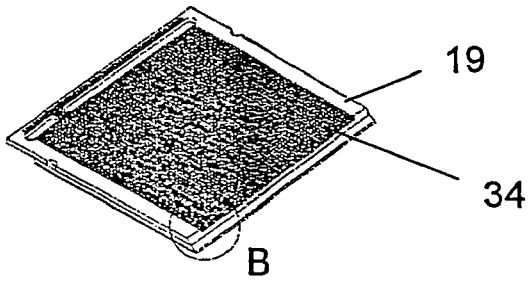
Figure 6D:
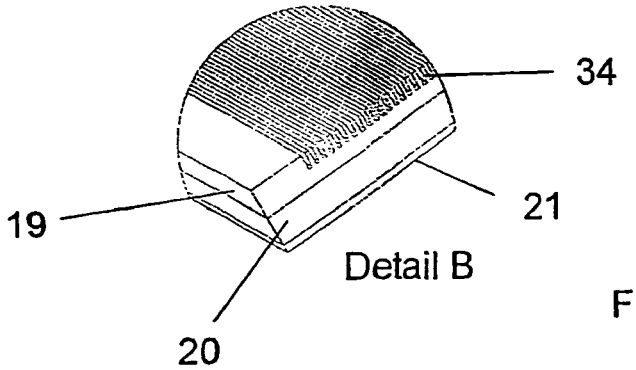
Figure 7:
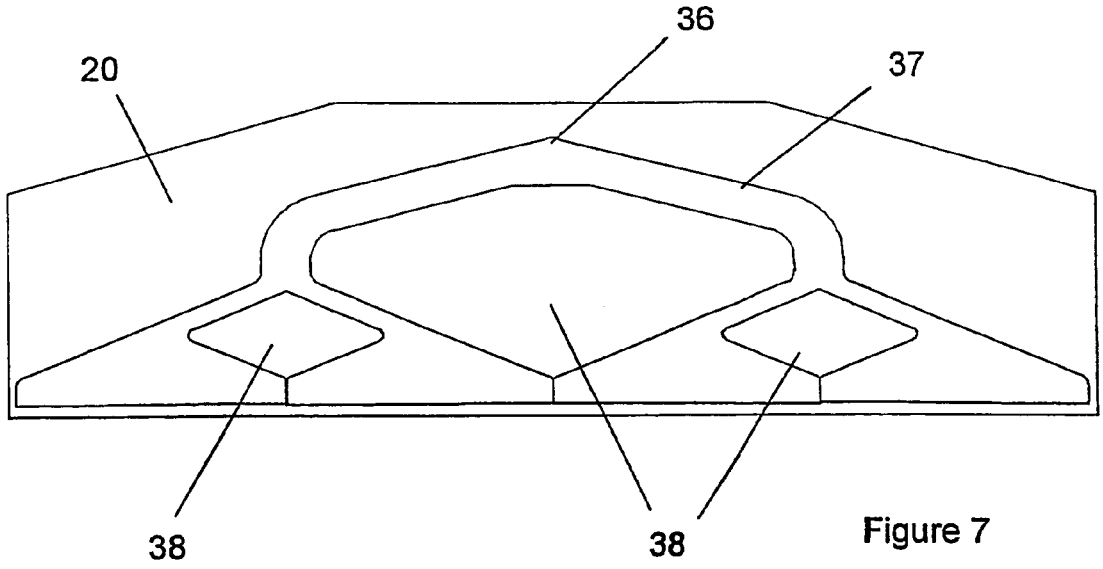
Figure 8:
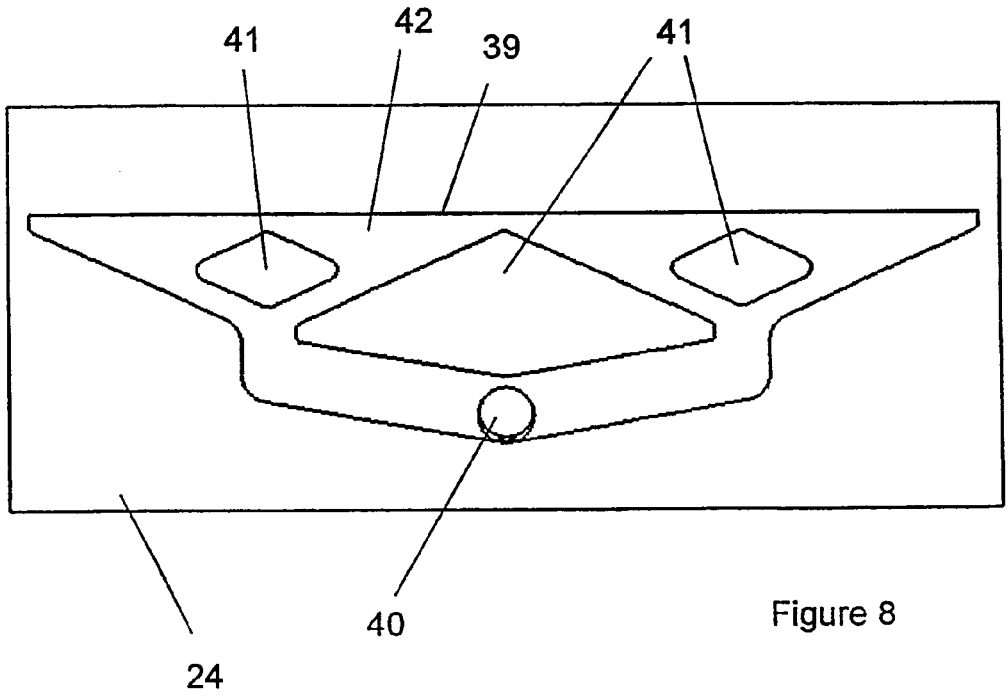
Figure 9:
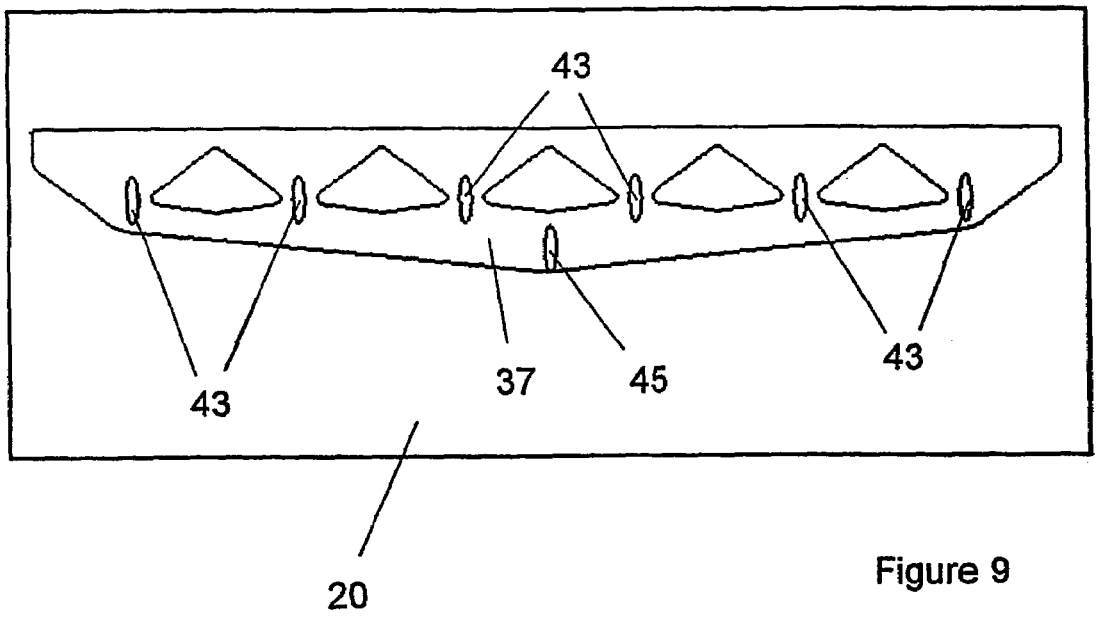

FIG. 5*a* in an exploded view of an ink inlet structure;

FIG. 5*b* is an exploded view of an ink outlet structure;

FIG. 6*a* is a perspective view of the ink inlet structure;

FIG. 6*b* is a detailed view of part of the ink inlet structure;

FIG. 6*c* is a perspective view of the ink outlet structure;

FIG. 6*d* is a detailed view of part of the ink outlet structure;

FIG. 7 is a schematic plan view of one example of a manifold;

FIG. 8 is a schematic plan view of an outflow manifold;

FIG. 9 is a schematic plan view of one example of an inflow manifold; and

Figure 10:
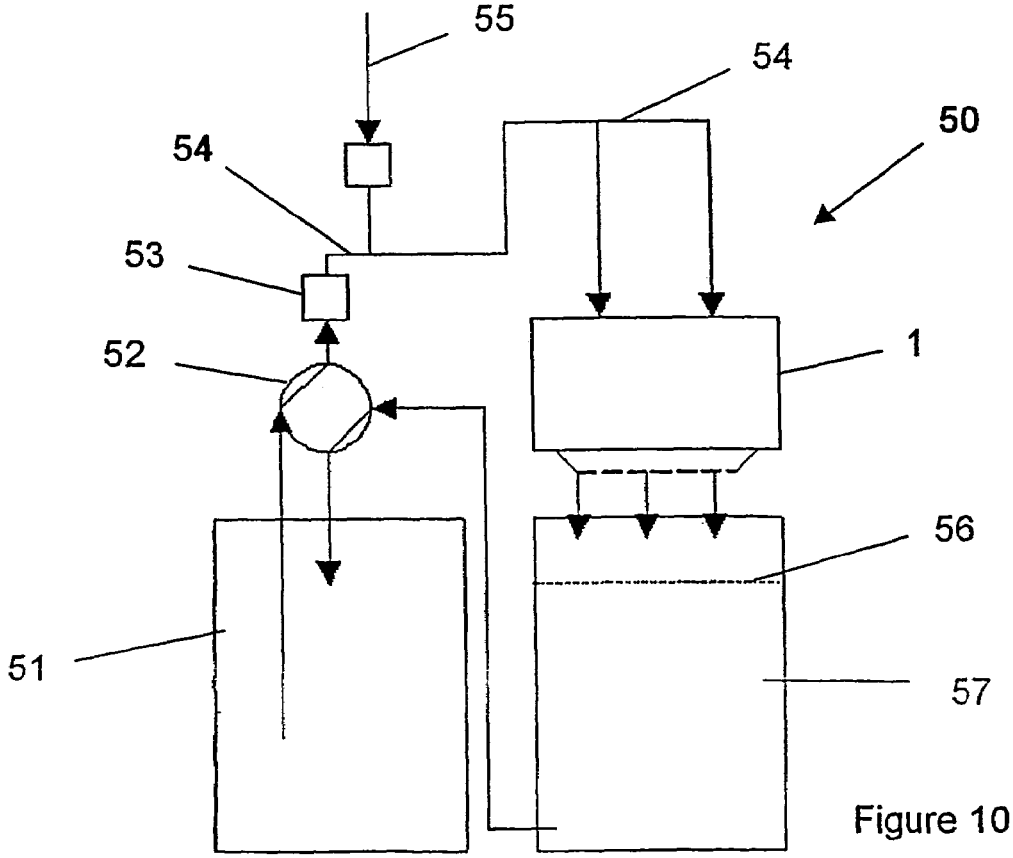

FIG. 10 is a schematic view of a maintenance system for use in the printhead.

Figure 1:
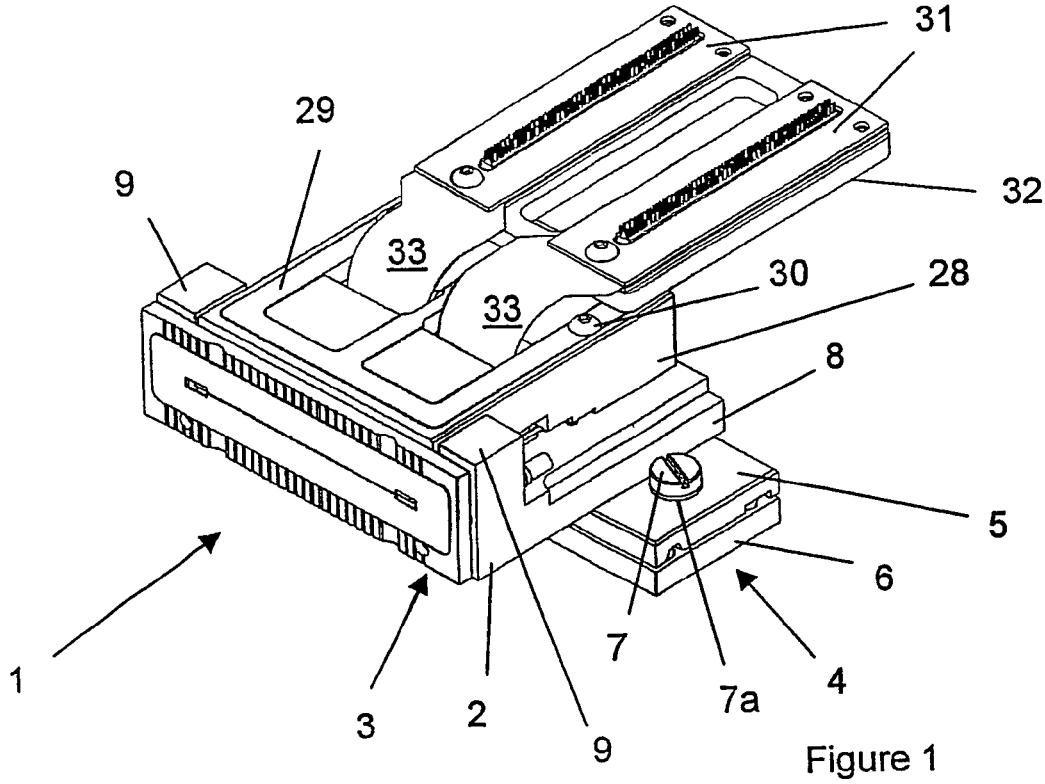
FIG. 1 is a perspective view of a printhead according to the present invention.

The printhead 1 shown in FIG. 1 comprises a main body 2 to which the remaining components are connected. On one end of the main body, an intermediate electrode plate 3 is mounted by means of a kinematic mount (see FIGS. 2 and 3). The main body 2 is connected to a mounting portion 4, comprising a location plate 5 and a fixed plate 6 held together by means of thumb screws 7 which pass through a wavy washer 7*a*.

The main body 2 comprises a substantially level base portion 8 and a pair of upstanding projections 9, to which the intermediate electrode plate 3 is mounted.

Figure 2:
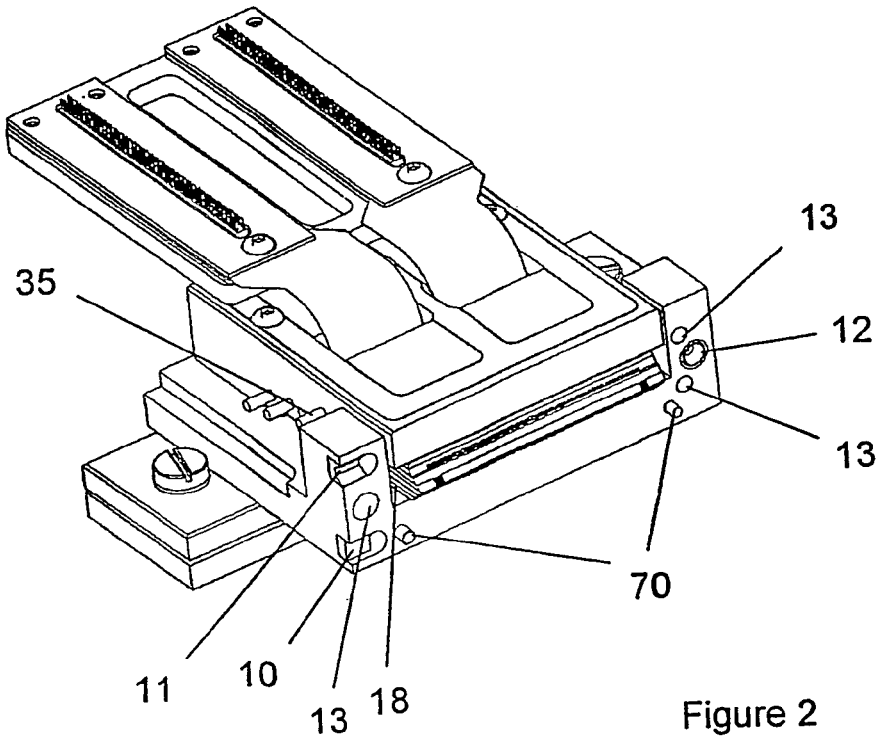
FIG. 2 shows a perspective view from the other side of the printhead with the intermediate electrode removed.
Figure 3:
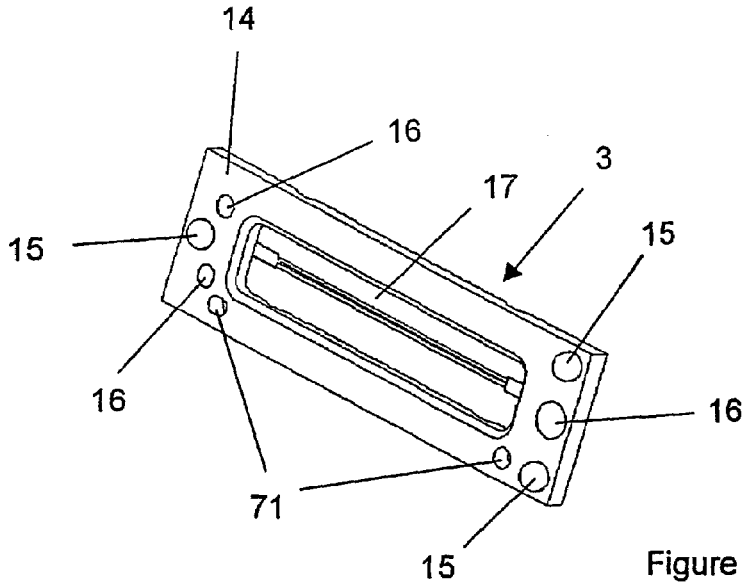
FIG. 3 shows the intermediate electrode.

As shown in FIG. 2, the kinematic insert comprises three recesses 10, 11, 12 on the main body and these include one flat bottomed recess 10, one V-shaped recess 11 and one conical recess 12. Magnets 13 are inserted in the surface of the main body.

The intermediate electrode plate 3 comprises a datum plate 14 to which ball bearings 15 and additional magnets 16 are fixed and the intermediate electrode 17 itself, which is mounted in an opening in the datum plate. Openings 71 are provided in the datum plate 14 to receive corresponding projections 70 on the housing 2. The projections could, of course, be located on the datum plate and the openings on the housing.

Figure 4:
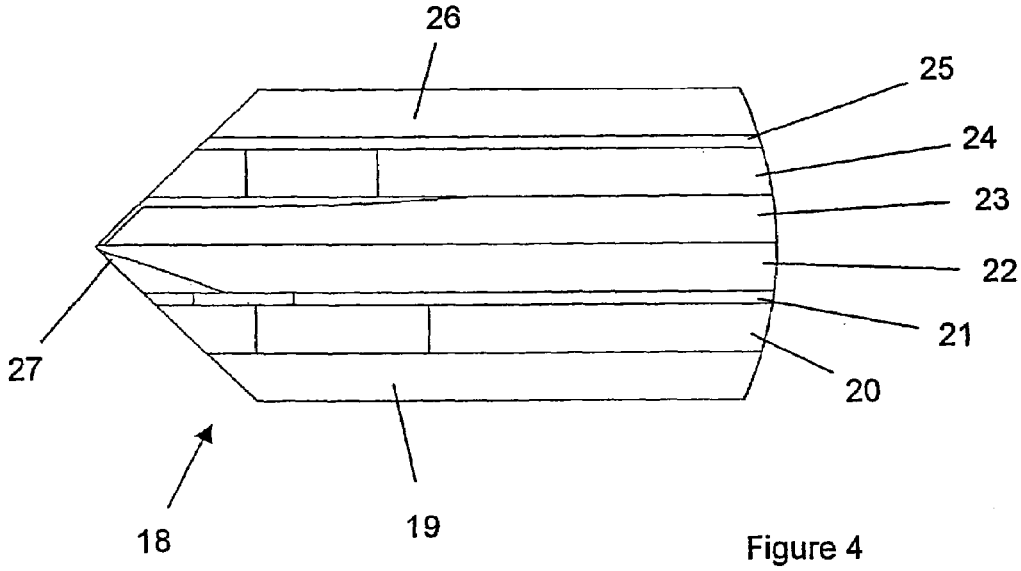
FIG. 4 is a schematic cross sectional view through the ejection portion of the printhead.

The flat portion 8 of the main body 2 supports a laminate structure 18, shown in FIG. 4, which includes a fluid flow layer 19, an ink outlet manifold 20, an ink outlet layer 21, a central tile 22, an ink inlet prism 23, an ink inlet manifold 24, an air bleed outlet 25 and an ink inlet layer 26, as can be seen in FIG. 4.

The central tile 22 includes channels (not shown) for supplying ink to an array of ejection locations 27.

The laminate structure 18 is held in place by an upper part 28 of the printhead which acts as a clamp and is held in place by means of a plate 29 which is fixed to the main body by means of screws 30.

The ejection locations 27 are controlled by means of electrical signals supplied via electrical connectors 31 which are mounted on rigid plates 32. The electrical connectors are each connected to a flexible sheet 33 which has individual electrical pathways corresponding to each ejection location, and these are connected to the individual channels in the central tile 22.

The fluid flow layer 19 shown in FIG. 4 include a series of narrow channels 34, shown in FIGS. 6*c* and 6*d*, through which a gas or a liquid, such as a rinse agent, can be caused to flow. Whilst only a single fluid flow layer is shown, it is envisaged that additional fluid flow layers could be included. This is discussed in greater detail with reference to FIG. 10.

The ink is supplied by means of ink supply tubes 35 in the printhead which feed ink through the ink inlet layer 26 and the air bleed layer 25, into the ink inlet manifold 24, examples of which can be seen in FIG. 7 and 9. The ink passes through chamber 37 in the manifold 24 and exits, through the ink inlet prism 23 to the ejection locations 27 on the central tile 22. The ink then flows from the central tile 22 through the ink outlet layer 21 into the ink outlet manifold 20, one example of which can be seen in FIG. 8. The ink leaves the ink outlet manifold and passes back into the bulk ink supply (not shown).

As can be seen in FIGS. 5*a*, 5*b* and 6*a* to *d*, the ink inlet prism 23 comprises a series of narrow channels 60, corresponding to each of the individual ejection locations 27 in the central tile 22. The ink passes along the channels 60 and enters the ejections locations 27. The outlet manifold 20 in FIG. 5*b* includes a triangular chamber 42, but this chamber may be the same shape as chamber 37 in the inlet manifold 24 or may be shaped as shown in FIG. 8.

FIG. 7 shows a schematic plan view of one example of an inlet manifold 24. The manifold is provided with an inlet 36 from the bulk ink supply which feeds into a manifold chamber 37. The chamber includes a number of supports 38 to maintain the required thickness of the chamber and, also, to direct the ink flow in the required directions.

FIG. 8 shows one example of an outlet manifold 20, in which the ink enters a manifold chamber 42 along the straight boundary 39 and passes through and exits via an ink outlet. Again, a number of supports 41 are provided to maintain the required thickness of the outflow manifold chamber. The supports 38 and 41 are optional.

FIG. 9 shows another example of an inlet manifold 24, in which a number of ink inlets 43 are provided, together with a number of support structures 44. An air bleed outlet 45 is also provided to remove air bubbles which may be entrained in the inlet ink flow and which are undesirable.

FIG. 10 shows the main features of a maintenance system 50 which could be used in the printhead shown in the earlier FIGS. The maintenance system includes a rinse reservoir 51 supplying a liquid to a pump 52 which delivers the flow via a valve 53 into a supply line 54 to the printhead 1. Also connected to this supply line via a further valve is a compressed air supply line 55. In this way, either liquid or air, or a combination, can be supplied through the channels 34 (not shown) in the ink flow path of the central tile 22 or the channels 34 of the fluid flow layer 19 shown in FIG. 5. The flow path includes the two manifolds and the ejection locations. The compressed air supplied via the airline 55 provides additional agitation in the flow, thereby improving the cleaning action of the fluid as it passes along the ink supply path. It is envisaged that the liquid and the gas may be supplied at the same time, or as separate flow streams, one after the other. The addition of the compressed air into the fluid also provides additional agitation at the printhead 1. By switching off this stream of air, fluid can be pumped into both sides of the printhead, leaving it fully primed. Additional valves (not shown) are provided to allow a user to switch between maintenance and printing configurations. The used clean fluid passes through a filter 56 into a filtered rinse collection reservoir 56 for recirculation back to the pump 52.

The maintenance system can be utilised to clean the ejection locations 27 or the intermediate electrode 17 or both. When cleaning the ejection electrodes, it is preferred that both rinse agent and compressed air are used.

When cleaning the intermediate electrode 17, the fluid flow, including compressed gas, acts as a gas brush.

Additional fluid outlets, directing fluid to other parts of the printhead, may be provided.

The invention claimed is:

1. A printhead comprising:

a housing having an inlet for the supply of ink;

an array of ejection locations for the ejection of ink droplets;

an ink supply pathway for the passage of ink from the inlet to the ejection locations, wherein the ink supply pathway comprises at least one divergent ink manifold; and an outlet manifold for receiving ink from the ejection locations during printing.

2. A printhead according to claim 1, wherein the manifold includes at least one inlet and at least one outlet for the passage of ink, the outlet supplying ink to the array of ejection locations.

3. A printhead according to claim 2, wherein the manifold is divergent in the direction from the inlet to the outlet.

4. A printhead according to claim 1, wherein the manifold is symmetrical about a line normal to and in the centre of the array of ejection locations.

5. A printhead according to claim 1, wherein the manifold is a triangular passageway.

6. A printhead according to claim 5, wherein the inlet is provided at an apex of the manifold and the outlet(s) is (are) on the side of the manifold opposite the inlet.

7. A printhead according to claim 5, further comprising an air bleed outlet at an apex of the manifold.

8. A printhead according to claim 1, wherein the manifold is substantially semi-circular.

9. A printhead according to claim 8, wherein the outlet(s) from the manifold are located on the substantially straight boundary of the manifold.

10. A printhead according to claim 1, wherein the manifold is a substantially elliptical or parabolic chamber.

* * * * *